US006731054B1

(12) United States Patent
Takeuchi et al.

(10) Patent No.: US 6,731,054 B1
(45) Date of Patent: May 4, 2004

(54) SHADOW MASK, CATHODE RAY TUBE, METHOD AND APPARATUS FOR MANUFACTURING SHADOW MASK

(75) Inventors: Yutaka Takeuchi, Ibo-gun (JP); Kazumasa Hirayama, Ibo-gun (JP); Masao Kobayashi, Ibo-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 327 days.

(21) Appl. No.: 09/716,400

(22) Filed: Nov. 21, 2000

(30) Foreign Application Priority Data

Dec. 27, 1999 (JP) ..... 11-371883

(51) Int. Cl.[7] ..... H01J 29/80

(52) U.S. Cl. ..... 313/407; 313/408; 313/402; 219/117.1

(58) Field of Search ..... 313/407, 402, 313/408, 461; 219/117.1, 50–162

(56) References Cited

U.S. PATENT DOCUMENTS 4,327,307 A * 4/1982 Penird et al. ..... 313/407
4,827,178 A * 5/1989 Higashinakagawa et al. ..... 313/402
4,949,009 A * 8/1990 Iwamoto ..... 313/407
5,910,702 A * 6/1999 Maehara ..... 313/407
6,274,974 B1 * 8/2001 Ito et al. ..... 313/402

FOREIGN PATENT DOCUMENTS

JP 52-48966 4/1977
JP 8-298078 11/1996

* cited by examiner

*Primary Examiner*—David V. Bruce
*Assistant Examiner*—Elizabeth Gemmell
(74) *Attorney, Agent, or Firm*—Oblon, Spivak, McClelland, Maier & Neustadt, P.C.

(57) ABSTRACT

A shadow mask for use in a cathode ray tube comprises a mask body having a mask effective section where a number of electron beam passage apertures are formed and a skirt portion provided at a peripheral edge of the mask effective section, and a mask frame arranged to be layered outside the skirt portion. The mask frame and the skirt portion are resistance-welded to each other at a plurality of portions. At each welding portion, a plurality of concave and/or convex portions each having a smaller area than an area of a contact surface of an electrode for resistance-welding are formed at an inner surface portion of the skirt portion which the electrode contacts.

8 Claims, 6 Drawing Sheets

SHADOW MASK, CATHODE RAY TUBE, METHOD AND APPARATUS FOR MANUFACTURING SHADOW MASK

CROSS-REFERENCE TO RELATED APPLICATIONS

This application is based upon and claims the benefit of priority from the prior Japanese Patent Application No. 11-371883, filed Dec. 27, 1999, the entire contents of which are incorporated herein by reference.

BACKGROUND OF THE INVENTION

The present invention relates to a shadow mask, a cathode ray tube comprising the shadow mask, and a method and an apparatus for manufacturing the shadow mask.

In general, a cathode ray tube used in a color television set or the like comprises a vacuum envelope including a panel and a funnel. A phosphor surface including blue (B), green (G), and red (R) phosphor layers and black layers formed therebetween is formed on the inner surface of the panel. In addition, a shadow mask is arranged inside the panel and opposes the phosphor surface.

The shadow mask comprises a mask body, which has a mask surface where a number of electron beam passage apertures are formed and a skirt portion at the peripheral edge part of the mask surface, and a mask frame, which is welded to the skirt portion of the mask body. Holders are welded to the respective corners of the mask frame. Further, panel pins provided on the inner wall of the panel are engaged in installation holes formed in the holder, respectively, thereby supporting the shadow mask at a predetermined position opposing the inner surface of the panel.

The panel thus equipped with the shadow mask is welded integrally to the funnel by frit glass, and thus, a glass valve is constructed as a vacuum envelope. In addition, an electron gun is arranged inside the neck of the funnel, and a deflection yoke is mounted on the outer circumferential surface of the funnel.

The mask body is formed in a predetermined shape by press-molding. The number of passage apertures are regularly arrayed in the mask surface, and the mask surface is formed with a predetermined curvature. In addition, the skirt portion is formed by bending the peripheral edge portion of the mask surface. After the press molding, the mask body is subjected to cleaning and process of blackening, so that a coating of a blackening film made of an oxide film is formed on the surface. This blackening film functions to prevent rust and reflection.

The mask frame of the shadow mask is also subjected to cleaning and process of blackening, after the press molding. The holder is welded to each corner or each side of the mask frame. This mask frame is welded to the outer surface of the skirt portion of the mask body at plural positions. Spot welding is adopted for the welding between the mask body and the mask frame.

According to a welding device used for the spot welding, the mask body is loaded, with the mask surface faced downward, into a lower metal mold which is processed so as to extend along the curved surface of the mask surface. Further, with the mask body kept pressed against the lower metal mold, the mask frame is overlapped on the outer surface of the skirt portion of the mask body, and a pair of electrodes provided at a welding head, which are a pressing-side electrode and a back electrode, are moved in the directions in which they come closer to each other. By this operation, the joining portions of the skirt portion of the shadow mask and the mask frame are clamped with a predetermined pressure between the pair of pressing-side electrode and the back electrode. Further, electric power is conducted between these electrodes so that the skirt portion and the mask frame are subjected to resistance-welding. That is, an electric current flows between the pressing-side electrode and the back electrode. Blackening films respectively formed on the surfaces of the skirt portion and the mask frame are then broken. Thereafter, the skirt portion and the mask frame are welded to each other thereby forming a welding portion called as a nugget.

Normally, iron is used for the mask frame, and iron or invar material is used for the mask body. Since a blackening film which has a low conductivity exists between the pressing-side electrode and the welding material during the welding, splashing occurs when the blackening film is broken or when metals are welded to each other. Splashes may scatter onto the mask surface and may cause clogging of the electron beam passage apertures.

Specifically, a plurality of amphitheatric circular or rectangular openings each having a diameter of 100 to 200 $\mu$m are bored in the front and back surfaces of the mask surface of the mask body. Each of these openings has a larger diameter in the side of the surface facing the phosphor surface of the panel and a smaller diameter in the side of the surface facing the electron gun. Each of the electron passage apertures is defined by a pair of larger and smaller diameter openings. Further, the welding between the skirt portion and the mask frame is carried out in a situation that the surface of the mask surface which faces the electron gun is oriented upward, i.e., in a situation that the small diameter openings are faced to the welding portion. Therefore, splashes scattering from the welding portion easily enter into the small diameter openings and causes clogging.

Also, the shadow mask is used in the process of forming the phosphor surface. That is, the phosphor surface is subjected to exposure processing through the apertures of the shadow mask. Specifically, three-color phosphor layers of blue, green, and red are exposed with light which has passed through one of the apertures in the shadow mask. Consequently, a defective phosphor surface is formed if the apertures of the mask body are clogged by splashes, dust, or foreign materials.

Further, at the same time when the blackening film is broken during welding, a larger current flows through the welding portion thereby increasing the temperature of this part. Therefore, the distal end of the pressing-side electrode is worn and comes to be easily oxidized. A problem hence arises in that the pressing-side electrode needs frequent polishing and that the lifetime of this electrode is shortened.

BRIEF SUMMARY OF THE INVENTION

The present invention has been made in view of the above problems and its object is to provide a shadow mask, a cathode ray tube comprising the shadow mask, and a method and apparatus for manufacturing the shadow mask, in which scattering of splashes is reduced so that apertures in the mask body can be prevented from being clogged due to splashes.

To achieve the above object, a shadow mask according to the present invention comprises: a mask body having a mask-effective section where a number of electron beam passage apertures are formed and a skirt portion provided at a peripheral edge of the mask-effective section; and a mask frame arranged outside the skirt portion and resistance-welded to the skirt portion at a plurality of welding portions, wherein the skirt portion includes an outer surface in contact with the mask frame, an inner surface positioned opposite to the outer surface, and a plurality of concave and/or convex portions are formed at the region of the inner surface of the skirt portion with which an electrode for resistance-welding contacts, in each of the welding portions, each of the plurality of concave and/or convex portions having a smaller area than an area of a contact surface of the electrode.

A cathode ray tube according to the present invention comprises: a panel provided with a phosphor screen on an inner surface of the panel; a shadow mask arranged facing the phosphor screen; and an electron gun for emitting an electron beam toward the phosphor screen through the shadow mask, wherein the shadow mask includes a mask body having a mask-effective section where a number of electron beam passage apertures are formed and a skirt portion provided at a peripheral edge of the mask-effective section, and a mask frame arranged outside the skirt portion and resistance-welded to the skirt portion at a plurality of welding portions, and the skirt portion includes an outer surface in contact with the mask frame, an inner surface positioned opposite to the outer surface, and a plurality of concave and/or convex portions are formed at the region of the inner surface of the skirt portion with which an electrode for resistance-welding contacts, in each of the welding portions, each of the plurality of concave and/or convex portions having a smaller area than an area of a contact surface of the electrode.

A method for manufacturing a shadow mask, according to the present invention, comprises the steps of: preparing a mask body having a mask effective section where a number of electron beam passage apertures are formed and a skirt portion provided at a peripheral edge of the mask effective section and having a plurality of concave and/or convex portions formed on an inner surface of the skirt portion; arranging a mask frame layered outside the skirt portion; clamping the skirt portion and the mask frame with a predetermined pressure, at a predetermined welding position, between a first electrode which contacts the inner surface of the skirt portion where the plurality of concave and/or convex portions are formed and a second electrode which contacts the outer surface of the mask frame; and conducting electricity between the first and second electrodes thereby to resistance-weld the skirt portion and the mask frame to each other.

According to the shadow mask, cathode ray tube, and the method of manufacturing a shadow mask which are structured as described above, a plurality of concave and/or convex portions each having a smaller area than the area of the contact surface of a welding electrode are formed on the inner surface of the skirt portion which contacts the welding electrode, at the welding portion between the mask body and the mask frame. Therefore, in welding, the contact area between the skirt portion and the welding electrode is reduced so that the pressure per unit area increases and the current density also increases. As a result, the amount of splashes caused from the welding portion is reduced. In addition, the surface part of the skirt portion is subdivided because a large number of concave or convex portions are formed. Also, the sizes of generated splashes are small because the contact area contacting the electrode is small. Further, it is advantageous that splashes which are smaller than the electron beam passage apertures formed in the mask body clogs no apertures even they scatter to the mask effective section.

Another method of manufacturing a shadow mask, according to the present invention, comprises the steps of: preparing a mask body having a mask effective section where a number of electron beam passage apertures are formed and a skirt portion provided at a peripheral edge of the mask effective section; arranging a mask frame layered outside the skirt portion; clamping the skirt portion and mask frame with a predetermined pressure, at a predetermined welding position, between a first electrode which contacts an inner surface of the skirt portion and a second electrode which contacts an outer surface of the mask frame; surrounding a contact portion between the first electrode and the inner surface of the skirt portion, and a periphery of the first electrode, with a cover for catching splashes; and conducting electricity between the first and second electrodes thereby to resistance-weld the skirt portion and the mask frame to each other.

Further, an apparatus for manufacturing a shadow mask, according to the present invention, comprises: a support portion for supporting a mask body having a mask effective section where a number of electron beam passage apertures are formed and a skirt portion provided at a peripheral edge of the mask effective section, and a mask frame provided to be layered outside the skirt portion; and a welding head for resistance-welding the skirt portion and the mask frame to each other at a predetermined welding position, the welding head including a first electrode which contacts an inner surface of the skirt portion, a second electrode which contacts an outer surface of the mask frame, a press portion for clamping the skirt portion and the mask frame between the first and second electrodes with a predetermined pressure, and a cover for catching splashes, surrounding a contact portion between the first electrode and the inner surface of the skirt portion and a periphery of the first electrode.

According to the method and apparatus described above, the contact portion between the first electrode and the inner surface of the skirt portion, and the periphery of the first electrode are surrounded by the cover. Splashes are caught by this cover. Scattering of splashes can thus be prevented.

Also, according to the present invention, the first electrode is cooled by supplying a cooling medium to the portion surrounded by the cover, so that generation of splashes can be hindered.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In the following, a color cathode ray tube according to an embodiment of the present invention will be explained in detail with reference to the drawings.

Figure 1:
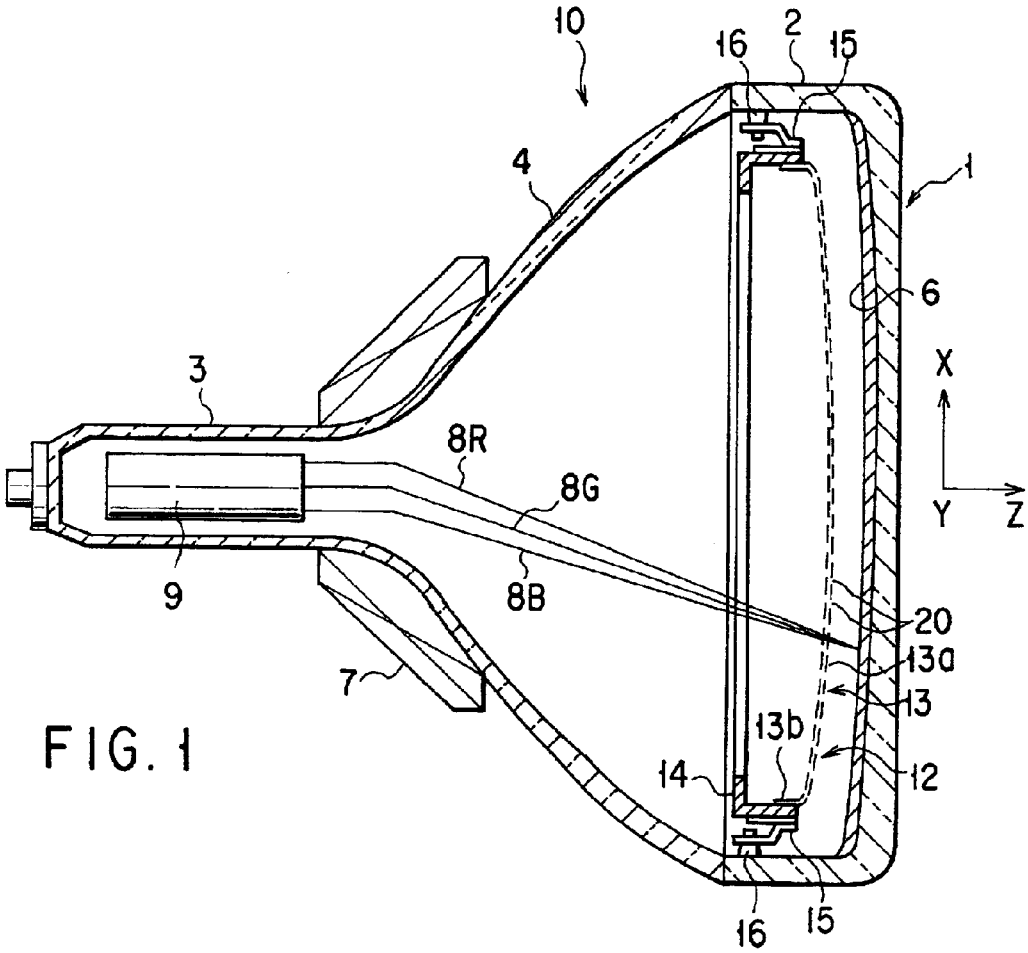
FIG. 1 is a cross-sectional view showing a cathode ray tube according to an embodiment of the present invention.

As shown in FIG. 1, the color cathode ray tube comprises a vacuum envelope 10 which includes a substantially rectangular panel 1 having a flat outer surface and a skirt portion 2 at its peripheral edges, a funnel 4 connected to the skirt portion of the panel, and a cylindrical neck 3 connected to the small diameter part of the funnel.

On the inner surface of the panel 1 is formed a phosphor screen comprising a plurality of dot-like phosphor layers which emit light in red, green, and blue and a black layer formed between the phosphor layers. A deflection yoke 7 having horizontal and vertical deflection coils is mounted on the envelope 10 and extends from the neck 3 to the funnel 4. Provided inside the neck 3 is an electron gun 9 which emits three electron beams 8R, 8G, and 8B toward the phosphor layers of the phosphor screen 6.

Figure 2:
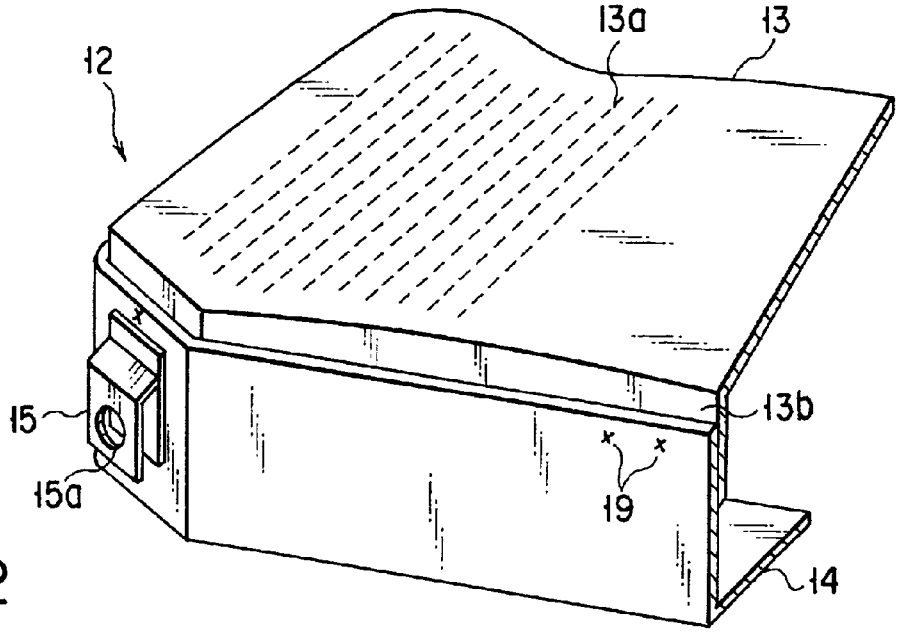
FIG. 2 is a perspective view showing a part of a shadow mask of the cathode ray tube.

A shadow mask 12 is arranged in the vacuum envelope 10 so as to face the phosphor screen 6. The shadow mask 12 comprises a rectangular mask body 1 made of iron, invar, or the like, and a mask frame 14 attached to the peripheral edges of the mask body. As shown in FIGS. 1 and 2, the mask body 13 has a rectangular mask effective section 13*a*, which faces the phosphor screen 6 and includes a number of electron beam passage apertures 20 formed therein, and a skirt portion 13*b* formed by bending the peripheral edge part of the mask effective Section 13*a*. Also, the mask frame 14 is made of, for example, iron and is arranged outside the skirt portion 13*b* of the mask body 13. The mask frame 14 is welded to the skirt portion 13*b* at plural portions 19.

A holder 15 as an elastic support member is welded to each of corner parts of the mask frame 14. Installation holes 15a are formed in the holder 15. The shadow mask 12 is detachably supported at a predetermined position relative to the inner surface of the panel 1, by engaging stud pins 16, which are fixed to the inner surface of the skirt portion 2 of the panel 1, into the installation holes 15*a* of the holders 15.

In the color cathode ray tube constructed as described above, three electron beams 8B, 8G, and 8R emitted from the electron gun 9 are deflected by the deflection yoke 7 mounted on the outer side of the funnel 4, thereby to horizontally and vertically scan the phosphor screen 6 through the electron beam passage apertures 20 of the shadow mask 12. A color image is thus displayed.

Next, the structure of the shadow mask 12 will now be explained in more details.

Figure 3:
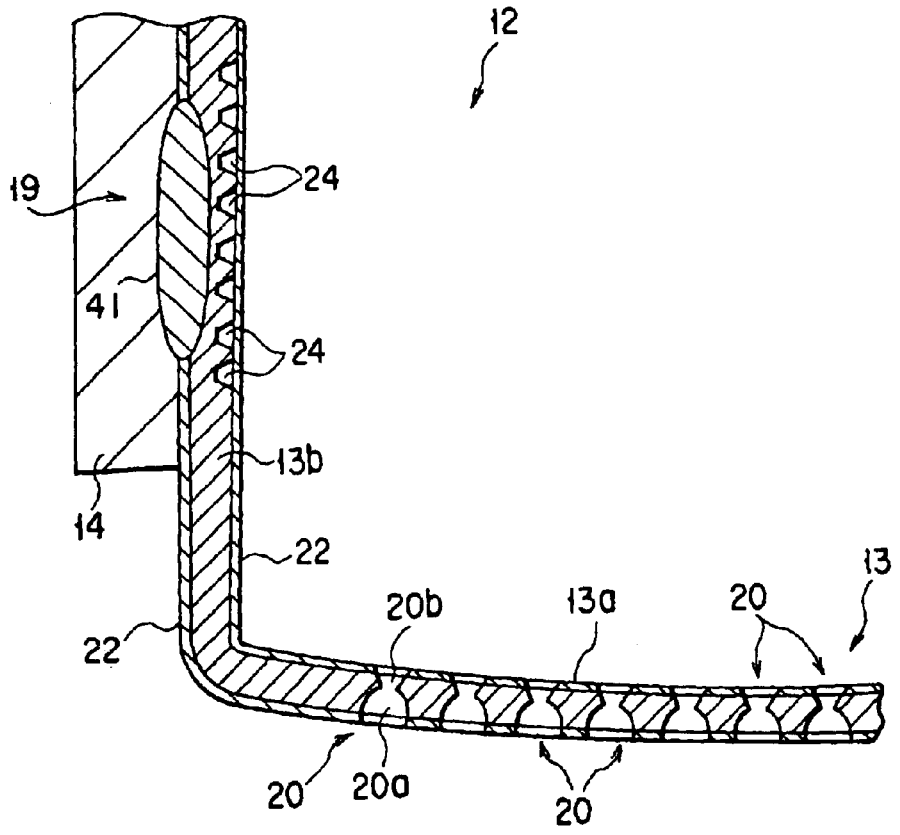
FIG. 3 is a cross-sectional view showing a welding portion and electron beam passage apertures of the shadow mask.

As shown in FIGS. 1 to 3, a number of electron beam passage apertures 20 are formed regularly in the mask effective section 13*a* which is formed with a predetermined curvature. Further, the mask body 13 has a thickness of 0.1 to 0.2 mm and is formed into a predetermined shape by press-molding. In addition, coatings of blackening films 22 are formed on the inner and outer surfaces of the mask body 13. These blackening films function to prevent rust and reflection.

Each electron beam passage aperture 20 is an opening which has a circular or rectangular amphitheatric shape of a diameter of 100 $\mu$m to 200 $\mu$m. Each aperture 20 is constructed by a large diameter hole 20*a* positioned on the side of the surface facing the phosphor surface 6 of the panel 1 and a small diameter hole 20*b* positioned on the side facing the electron gun 9.

The mask frame 14 has a thickness of about 0.8 to 1.2 mm and is formed in a substantially rectangular shape by press molding. A blackening film is formed on the surface of the mask frame 14. Further, the mask frame 14 is welded to the skirt portion 13*b* of the mask body 13 at a plurality of welding points 19.

Spot welding is used for the welding between the mask body 13 and the frame 14. As shown in FIG. 3, a plurality of concave portions 24 are formed at least on the inner surface of the skirt portion 13*b* at the positions of the welding points 19. These concave portions 24 are each formed like a dimple having a smaller area than the area of the end surface of the pressing-side electrode of the welding device which will be described later, and are also formed over a larger area than the area of the end surface of the pressing-side electrode.

Next, explanation will be made of a method for manufacturing the color cathode ray tube structured as described above, and particularly, a method for manufacturing the shadow mask together with the welding device.

Figure 4:
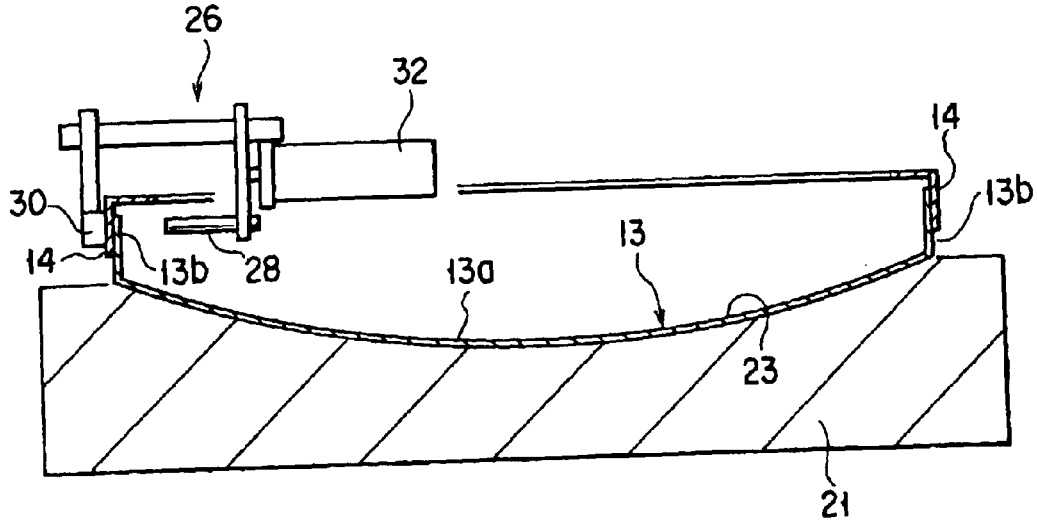
FIG. 4 is a partially-cut-away side view showing a welding device according to the embodiment of the present invention.

Explained at first will be a welding device used for welding between the skirt portion 13*b* of the mask body 13 and the mask frame 14. As shown in FIG. 4, the welding device comprises a lower metal mold 21 for supporting the shadow mask 12 and a welding head 26 supported on a support frame not shown. A concave portion 23 having a curved surface corresponding to the mask effective section 13*a* of the mask body 13 is formed on the upper surface of the lower metal mold 21 which functions as a support portion. Also, the welding head 26 of the welding device comprises a pair of electrodes, which are a long rod-like pressing-side electrode 28 and a back electrode 30, and a cylinder 32 as a pressing portion which moves these electrodes in the directions in which they come closer to each other thereby to clamp the welding portion with a predetermined pressure between these electrodes.

Figure 5:
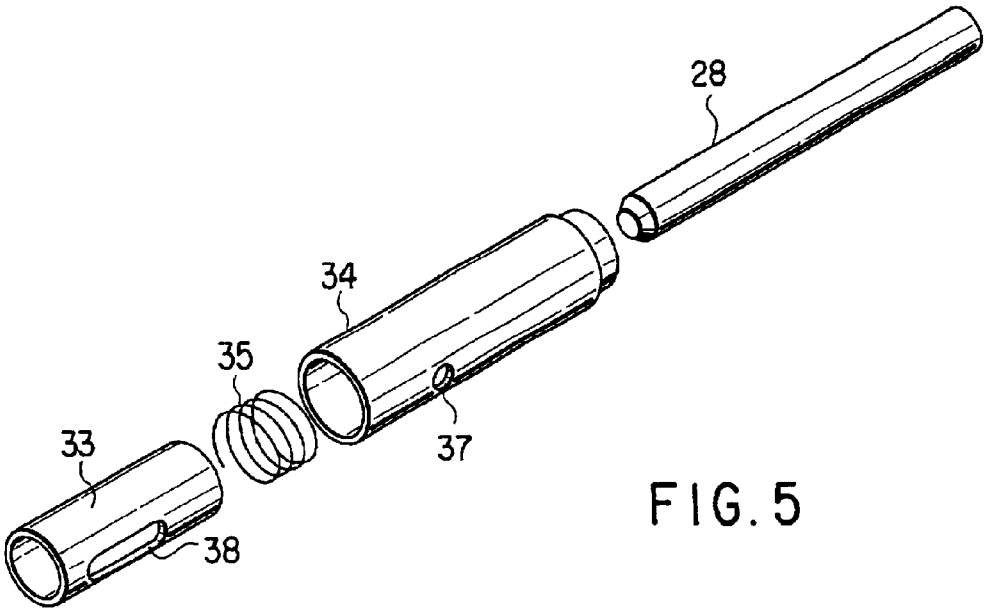
FIG. 5 is an exploded perspective view showing a pressing-side electrode of the welding device.
Figure 6:
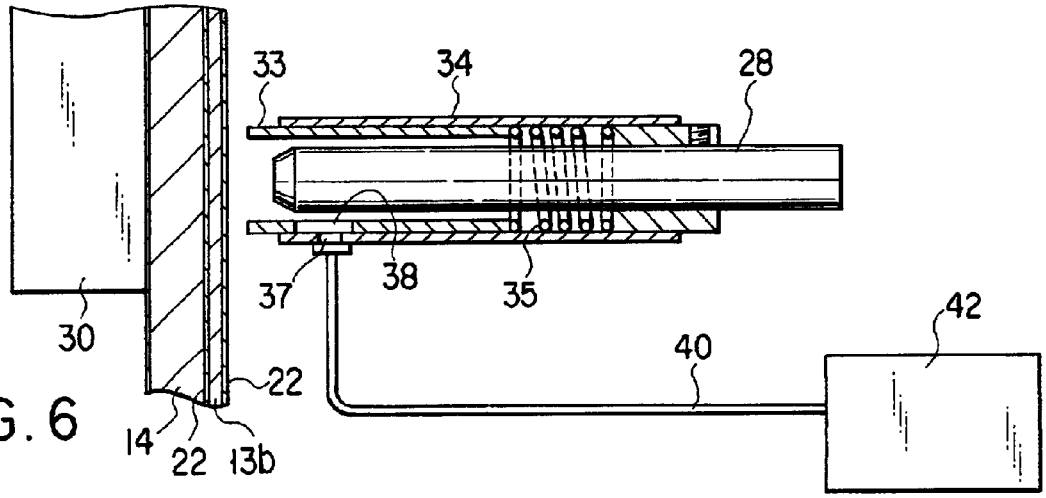
FIG. 6 is a cross-sectional view showing a welding portion of the shadow mask and the pressing-side electrode.

As shown in FIGS. 5 and 6, a cylindrical slide cover 33 is arranged around the pressing-side electrode 28, to catch splashes and prevent scattering during welding. The slide cover 33 is slidably held in a cylindrical fixed cover 34 equipped near the distal end portion of the pressing-side electrode 28, and a compression spring 35 is provided between the inner end of the slide cover 33 and the inner bottom portion of the fixed cover 34.

In the welding process, as shown in FIG. 4, the mask body 13 is set on the lower metal mold 21 with the convex outer surface of the mask effective section 13*a* kept in contact with the concave portion 23, i.e., with the mask body 13 faced downwards. Further, the frame 14 is overlapped on the outer surface of the skirt portion 13*b* of the shadow mask 13, with the mask effective section 13*a* pressed against the lower metal mold 21.

As shown in FIG. 6, the back electrode 30 is positioned to contact the outer surface of the welding portion of the mask frame 14, and the pressing-side electrode 28 is faced to the inner surface of the skirt portion 13*b* of the mask body 13. Subsequently, the pressing-side electrode 28 and the back electrode 30 of the welding head 26 are moved in the directions in which they come closer to each other.

By this operation, the joining portions of the skirt portion 13*b* and the mask frame 14 are clamped with a predetermined pressure between the pair of pressing-side electrode 28 and back electrode 30. At this time, the slide cover 33 of the pressing-side electrode 28, which normally projects over the distal end of the pressing-side electrode 28, contacts the inner surface of the skirt portion 13*b* at the welding portion prior to the pressing-side electrode 28 during the welding. The slide cover, 33 thereby surrounds the press contact portion of the distal end of the pressing-side electrode 28, i.e., the periphery of the welding portion.

With the welding portion thus clamped between the back electrode 30 and the pressing-side electrode 28, electricity is conducted between these electrodes to subject the skirt portion 13*b* and the mask frame 14 to resistance-welding. That is, a current is let flow between the pressing-side electrode 28 and the back electrode 30, and then, the blackening films as oxide films respectively formed on the surfaces of the skirt portion 13*b* and the mask frame 14 are broken. Thereafter, the skirt portion 13*b* and the mask frame 14 are welded to each other to form a welding portion called a nugget 41 (FIG. 3).

Normally, iron is used for the mask frame 14, and iron or invar is used for the mask body 13. Since blackening films 22 are interposed between the pressing-side electrode 28 and materials to be welded during the welding, splashing is caused when the blackening films 22 are broken or when metal materials are welded to each other.

However, the press contact portion at the top end part of the pressing-side electrode 28, which means the periphery of the welding portion, is surrounded by the slide cover 33. Therefore, if splashing is caused due to the welding operation, splashes can be caught by the slide cover 33 and can be prevented from scattering to the periphery.

Figure 7:
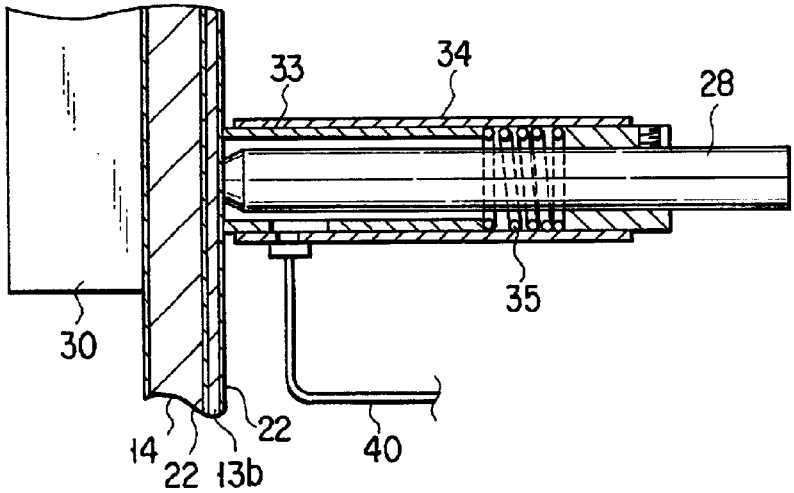
FIG. 7 is a cross-sectional view showing a state where the pressing-side electrode contacts the welding portion of the shadow mask.

As shown in FIGS. 5 to 7, according to the present embodiment, a through hole 37 is formed in the outer circumference of the distal end portion of the fixed cover 34, and a slit 38 extending in the axial direction of the cover is formed in the slide cover 33 provided slidably inside the fixed cover 34. A cooling medium supply device 42 is connected to the through hole 37 through a pipe 40.

During the welding, an inactive gas used for cooling such as a nitrogen gas (N2) may be supplied into the slide cover 33 through the pipe 40, through hole37, and the slit 38 from the cooling medium supply part 42, and may be blown to the welding portion. If the inactive gas is thus blown to the welding portion, the pressing-side electrode 28 is cooled so that oxidization can be prevented and splashing can be hindered. In this manner, the welding conditions are stabilized, and the lifetime of the pressing-side electrode 28 can be maintained long.

In addition, the same hole and slit as the through hole 37 and the slit 38 may be provided respectively at different positions on the fixed cover 34 and the slide cover 33, and a vacuum device may be connected thereto. The structure may be arranged such that suction and removal can be securely achieved by the vacuum device without scattering out the splashes caught by the cover 33.

Figure 8:
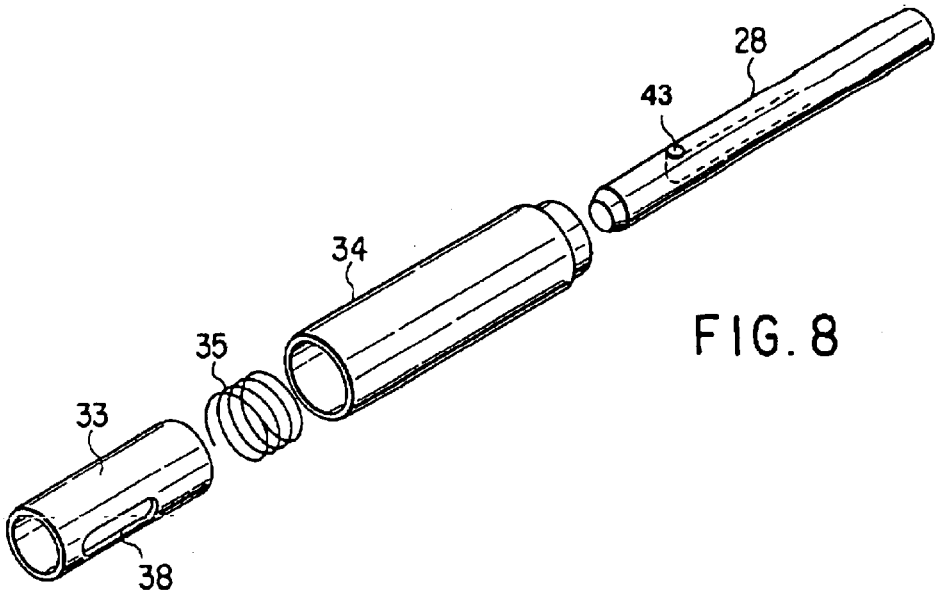
FIG. 8 is an exploded perspective view showing a modification example of the pressing-side electrode.

In the above embodiment, the supply device 42 for an inactive gas or a suction means for suctioning splashes is connected to the through hole 37 provided in the fixed cover 34 and the slit 38 provided in the slide cover 33. However, as shown in FIG. 8, a passage 43 which is opened in the outer circumferential surface near the distal end of the pressing-side electrode 28 and penetrates through the axial center part thereof to the bottom end part thereof, may be formed in the pressing-side electrode 28. This passage 43 may be used as a supply passage for the inactive gas or a suction passage for suctioning splashes.

In the welding device described above, splashes which are generated at the welding portion are caught by the slide cover 33 to prevent them from scattering to the periphery. However, it is basically preferred that the generation amount of splashes itself can be reduced.

Figure 9:
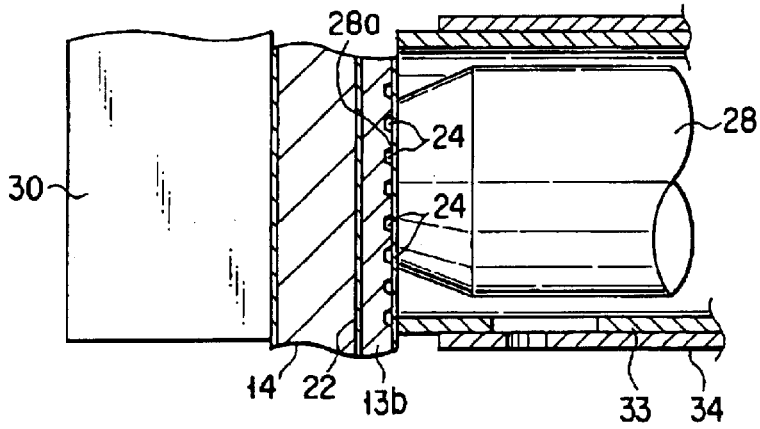
FIG. 9 is a cross-sectional view showing a step of spot-welding the skirt portion of the mask body of the shadow mask and the mask frame to each other.
Figure 10:
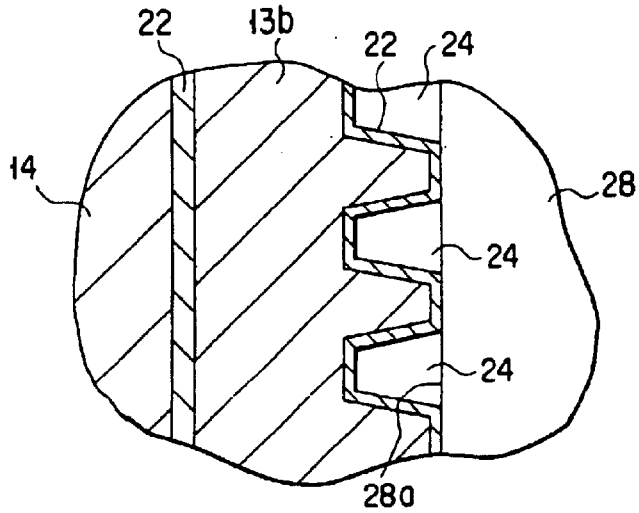
FIG. 10 is an enlarged cross-sectional view showing a contact portion between the inner surface of the skirt portion and the pressing-side electrode.
Figure 11:
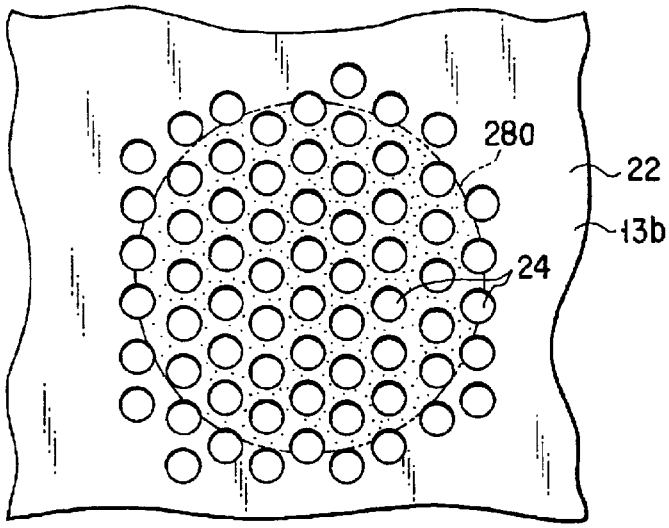
FIG. 11 is an enlarged plan view showing a part of the inner surface of the skirt portion.
Figure 12:
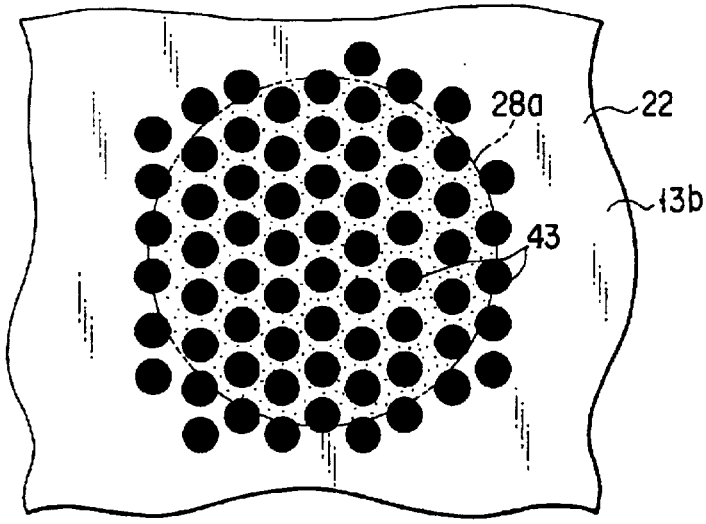
FIG. 12 is a plan view showing a modification example where convex portions are provided in the inner surface of the skirt portion.

Hence, according to the present embodiment, a plurality of concave portions 24 are provided at least on the inner surface of the skirt portion 13*b* of the mask body 13, to reduce the generation amount of splashes from the welding portion. That is, as shown in FIGS. 9 to 11, a plurality of concave portions 24 each having a smaller area than the distal end surface 28*a* of the pressing-side electrode 28 are formed in that region of the inner surface of the skirt portion 13*b,* which the distal end surface of the pressing-side electrode 28 contacts, at the welding portion between the skirt portion 13*b* and the mask frame 14. For example, a large number of dimple-like concave portions 24 are formed.

These concave portions 24 are formed, for example, by photo-etching at the same time when the electron beam passage apertures 20 of the shadow mask 12 are formed. That is, in manufacture of the shadow mask 12, a resist is applied to both the front and back surfaces of a strip-like iron or invar material. In an exposure step, a desired pattern is printed on the resists on both the front and back surfaces. Thereafter, a developing step and an etching step based on a ferric chloride solution are carried out, thereby to form a large number of electron beam passage apertures 20 each having an amphitheatric cross-section, as shown in FIG. 3.

Therefore, when the electron beam passage apertures 20 are formed in the mask body by etching in the process of manufacturing the shadow mask 12, dimple-like concave portions 42 are also formed, together with the electron beam passage apertures, in the inner surface of the skirt portion 13*b*. Also, in this case, each electron beam passage aperture 20 is constructed by a large diameter hole 20*a* on the side of the outer surface facing the phosphor screen and by a small diameter hole 20*b* on the side of the inner surface facing the electron gun.

As shown in FIGS. 9 to 11, the pressing-side electrode 28 contacts the side of the inner surface of the skirt portion 13*b*, which is the same surface side where the small diameter holes 20*b* are formed. In the process of manufacturing the mask body 13, a desired pattern is also printed on the surface of the skirt portion 13*b*, which is then etched at the same time when the small diameter holes 20*b* are etched. As a result, a half-etched surface which is etched only at a part in the thickness direction so that the etching might not penetrate the skirt portion 13*b* is formed on the inner surface of the skirt portion 13*b* at the welding portion. A large number of concave portions 24 are thus formed.

The pitch of the concave portions 24 can be set arbitrarily by changing the negative pattern used for the exposure. The concave portions 24 are formed with a depth of 0.01 to 0.1 mm and a diameter of 0.2 to 0.6 mm at a pitch of 0.3 to 0.8 mm. For example, in case of using a mask material having a plate thickness of 0.25 mm and a pressing-side electrode 28 whose distal end surface 28*a* has a diameter of 3.0 mm, the concave portions 24 are formed to have a depth of 0.05 mm and a diameter of 0.45 mm at a pitch of 0.6 mm. Further, these concave portions 24 are formed in the inner surface of the skirt portion 13*b* over a broader range than the area which the distal end surface 28*a* of the pressing-side electrode 28 contacts. Where 100% is the contact area between the distal end surface 28*a* of the pressing-side electrode 28 and the inner surface of the skirt portion 13*b* when no concave portions are formed in the inner surface of the skirt portion 13*b*, the concave portions 24 are formed to have such a diameter and pitch that reduce the contact area to about 50 to 10%.

After the electron beam passage apertures 20 and the concave portions 24 are formed in the mask body 13 as described above, blackening films are formed on the inner and outer surfaces of the mask body.

With a large number of concave portions 24 thus formed in the inner surface of the skirt portion 13*b* at the welding portion, the skirt portion 13 and the mask frame 14 are clamped with a predetermined pressure by the back electrode 30 and the pressing-side electrode 28 of the welding device, as described previously, and electricity is conducted between these electrodes to achieve resistance-welding.

In this structure, the contact area between the blackening film 22 on the skirt portion 13*b* and the distal end surface 28*a* of the pressing-side electrode 28 is reduced by providing a large number of concave portions 24 at the welding portion, so that the pressure per unit area at the contact area increases and the current density also increases. As a result of this, the amount of splashes generated from the welding portion is reduced. In addition, the contact area between the blackening film 22 and the distal end surface 28*a* of the pressing-side electrode 28 is reduced, so that the absolute amount of the portion of the blackening film that is melted and splashes can be reduced. Further, the sizes of the splashes are reduced because the blackening film 22 is subdivided by forming the large number of concave portions 24 so that the contact area with respect to the pressing-side electrode 28 is small. In addition, it is advantageous that those splashes that are smaller than the small diameter hole 20*b* do not cause clogging even if they scatter to the mask effective section 13*a*.

These concave portions 24 function to maintain excellent contact between the skirt portion 13*b* and the mask frame 14 or pressing-side electrode 28. That is, compared with the case where no concave portions exist, the pressure per unit area is larger when the skirt portion 13*b* is pressed by the pressing-side electrode 28. Therefore, the skirt portion 13*b* can be more easily deformed in compliance with the shape of the distal end surface 28*a* of the pressing-side electrode 28, so that the tightness of the contact with the frame 14 is improved. Accordingly, the contact resistance of the welding portion is reduced. In general, splashing is caused when the pressing force at the welding portion is insufficient or when the electric resistance is large. Therefore, generation of splashes can be reduced greatly by reducing the electric resistance as described above.

Further, the welding energy is not used for scattering splashes but is used for the original purpose of welding because the generation amount of splashes is reduced. The weld strength can therefore be improved.

As a result of this, the generation amount of splashes is reduced to about half, compared with the case where concave portions 24 are not provided, and the size of the nugget 40 (see FIG. 3) as a welding portion increases so that its diameter increases from 1.3 mm to 1.9 mm. Thus, the strength of the welding portion is improved. Further, oxidization and wear of the welding electrodes are prevented from being improved, as the splashes decrease. Accordingly, the lifetime of the electrodes can be extended. In addition, the concave portions 24 can be formed at the same time when the electron beam passage apertures 20 of the shadow mask 12 are formed. Therefore, the concave portions 24 can be formed easily without increasing the number of manufacturing steps.

In the embodiment described above, columnar convex portions 43 may be formed at the welding portion in place of the concave portions 24. These convex portions 43 are arranged to have a diameter of about 0.6 mm which is sufficiently small in comparison with the diameter of 2 to 3 mm of the distal end surface 28 of the pressing-side electrode 28. These convex portions 43 can also be formed easily by photo-etching.

Further, in case of using these convex portions 43, it is possible to obtain the same advantages as described above. In addition, those portions that contact the pressing-side electrode 28 are scattered like islands due to the convex portions 43, so that the size of each splash can be much more reduced.

Figure 13:
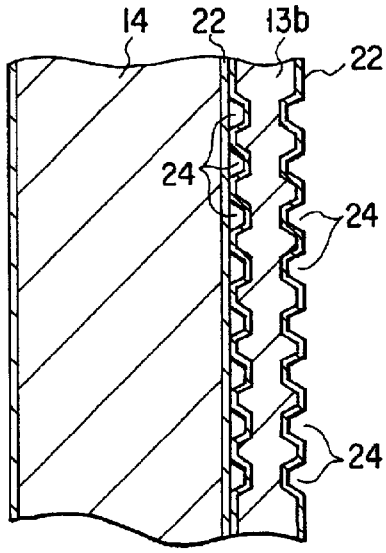
FIG. 13 is a cross-sectional view showing a welding portion where concave portions are provided in both surfaces of the skirt portion of the shadow mask.

Also, at the welding portion, similar concave portions 24 may be provided not only in the inner surface of the skirt portion 13*b* of the shadow mask 13 but also in the outer surface thereof contacting the mask frame 14, as shown in FIG. 13. These concave portions 24 can also be formed easily by photo-etching.

Further, in the spot welding, the pressure and contact tightness per unit area with respect to the mask frame 14 can be more improved by thus providing concave portions 24 in the inner and outer surfaces of the skirt portion 13*b* at the welding portion. Accordingly, the generation amount of splashes can be reduced as the contact pressure and contact resistance decrease. In addition, the improvement of the weld strength can be more progressed due to the increase of the nugget area as the welding portion.

Further, in the present invention, the concave portions 24 are not limited to those obtained by half-etching the mask body but may be through holes which penetrate through the skirt portion 13*b*. These through holes can be formed by photo-etching the mask body 1, like the above embodiment. By thus forming through holes at the skirt portion 13*b*, the pressure per unit area on the contact surface between the pressing-side electrode 28 and the mask frame 14 increases at the welding portion during the welding. In addition, the contact tightness is improved thereby reducing the contact resistance. Therefore, the generation amount of splashes can be greatly reduced, and the strength of the welding portion can be improved.

At the welding portion between the mask frame and the skirt portion, concave or convex portions similar to those described above may be formed in the inner surface of the mask frame, i.e., in the contact surface to the skirt portion, in addition to the concave portions 24 and convex portions 43 formed in the inner surface of the skirt portion.

Figure 14:
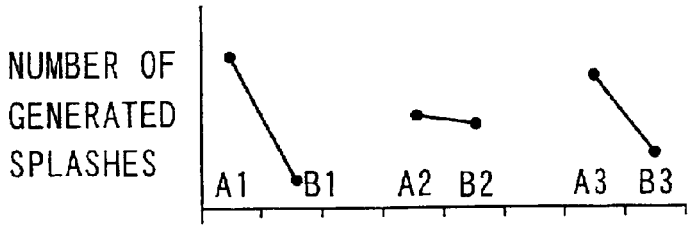
FIG. 14 is a graph showing a relationship between the welding condition of the welding portion of the shadow mask and the splash generation amount.
Figure 15:
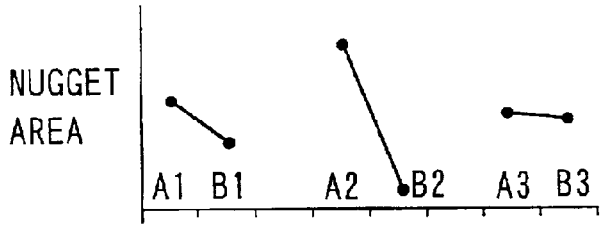
FIG. 15 is a graph showing a relationship between the welding condition of the welding portion of the shadow mask and the quality of the welded state.
Figure 16:
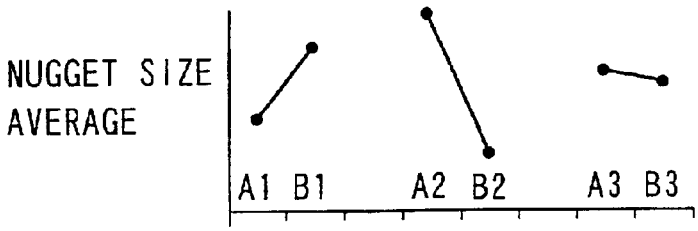
FIG. 16 is a graph showing a relationship between the welding condition of the welding portion of the shadow mask and the sensitivity in the welded state.

FIGS. 14 to 16 show effects obtained when welding the mask frame and the skirt portion of the mask body to each other, compared among cases of A1 where water cooling is used for the welding electrodes, A2 where concave portions are formed at the skirt portion, A3 where nitrogen is blown to the welding portion, B1 where no water cooling is used for the welding electrodes, B2 where no concave portions are formed at the skirt portion, and B3 where no nitrogen is blown to the welding portion. In each figure, the ordinate expresses the S/N ratio. The greater the numerical value in the ordinate, the stronger against noise as disturbance the welding portion. That is, it can be said that the condition provides so-called robustness.

At first, FIG. 14 shows the number of generated splashes. As the greater the numerical value increases in the ordinate, the number of generated splashes is reduced and the variants thereof are also reduced. It is found that the number of generated splashes is more reduced in the case A1 of using water cooling for the welding electrodes than in the case B1 of using no water cooling for the welding electrodes, in the case A2 of forming concave portions at the skirt portion than in the case B2 of forming no concave portions at the skirt portion, as well as in the case A3 of blowing nitrogen to the welding portion than in the case B3 of blowing nitrogen to the welding portion. The variants of the number of splashes are reduced to be small preferably.

FIG. 15 shows the quality of the welded state. As the value rises upward along the ordinate, the area of the nugget increases so that the welding strength increases, and the variants of the area of the nugget are reduced. It is preferably found that the area of the welding nugget is larger, the welding strength is higher, and the variants of the area of the nugget are reduced more in the case A1 of using water cooling for the welding electrodes than in the case B1 of using no water cooling for the welding electrodes, in the case A2 of forming concave portions at the skirt portion than in the case B2 of forming no concave portions at the skirt portion, as well as in the case A3 of blowing nitrogen to the welding portion than in the case B3 of blowing nitrogen to the welding portion.

Further, FIG. 16 shows the sensitivity in the welded state. As the value rises along the ordinate, the average value of the sizes of the nuggets increases. It is preferably found that the average value of the sizes of the nuggets is higher, in the case A1 of using water cooling for the welding electrodes than in the case B1 of using no water cooling for the welding electrodes, in the case A2 of forming concave portions at the skirt portion than in the case B2 of forming no concave portions at the skirt portion, as well as in the case A3 of blowing nitrogen to the welding portion than in the case B3 of blowing nitrogen to the welding portion.

As is apparent from FIGS. 14 to 16, more excellent effects are obtained with respect to respective factors, by providing concave portions at the skirt portion of the mask body in any cases.

Figure 17:
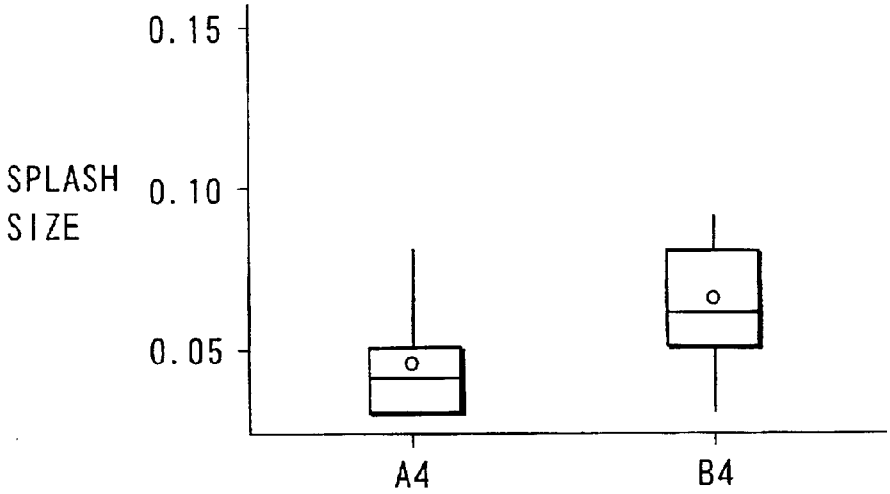
FIG. 17 is a graph which compares the sizes of splashes between the case where concave portions are provided at the welding portion and the case where no concave portions are provided.

Further, FIG. 17 is a distribution map or a box chart of the sizes of the splashes, comparing the sizes of splashes between a case A4 where concave portions are provided in the skirt portion of the mask body and a case B4 where they are not provided. With respect to each box, the upper side of the box denotes the 3/4 digits, the lower side denotes the 1/3 digit, the lateral line in the box denotes the center value, the circle mark denotes the average value, the upper extension denotes the maximum value, and the lower extension denotes the minimum value. It is found that the sizes of the splashes are far smaller in the case A4 of providing concave portions than in the case B4 of providing no concave portions.

The present invention is not limited to the embodiment described above but may be variously modified within the scope of the invention. For example, the shapes and size of respective structural components of the cathode ray tube and those of welding electrodes in the welding device may be variously selected upon requirements.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A shadow mask for use in a cathode ray tube, comprising:

a mask body having a mask effective section where a number of electron beam passage apertures are formed and a skirt portion provided at a peripheral edge of the mask effective section; and a mask frame arranged outside the skirt portion and resistance-welded to the skirt portion at a plurality of portions, wherein the skirt portion includes an outer surface in contact with the mask frame, an inner surface positioned opposite to the outer surface, and at least one of: (i) a plurality of concave portions and (ii) a plurality of convex portions formed on that region of the inner surface of the skirt portion which a contact surface of an electrode for resistance-welding contacts, in each of the welding portions, said at least one of: (i) the plurality of concave portions and (ii) the plurality of convex portions each having a smaller area than an area of the contact surface of the electrode, the contact surface of the electrode having a diameter smaller than a width of the skirt portion.

2. A shadow mask according to claim 1, wherein the skirt portion includes at least one of: (i) a plurality of concave portions and (ii) a plurality of convex portions formed in the outer surface, at each of the welding portions, said at least one of: (i) the plurality of concave portions and (ii) the plurality of convex portions each having a smaller area than the area of the contact surface of the electrode.

3. A shadow mask according to claim 1, wherein said at least one of: (i) a plurality of concave portions and (ii) a plurality of convex portions are formed to have a diameter and a pitch such that a contact area between the contact surface of the electrode and the inner surface of the skirt portion is 50 to 10% of the contact surface of the electrode.

4. A shadow mask according to claim 1, wherein the mask body has an oxide film which covers an entire surface of the mask body, and the mask frame has an oxide film which covers an entire surface of the mask frame.

5. A cathode ray tube comprising:

a panel provided with a phosphor screen on an inner surface of the panel;

a shadow mask arranged facing the phosphor screen; and an electron gun for emitting an electron beam onto the phosphor screen through the shadow mask, wherein the shadow mask includes a mask body having a mask effective section where a number of electron beam passage apertures are formed and a skirt portion provided at a peripheral edge of the mask effective section, and a mask frame arranged outside the skirt portion and resistance-welded to the skirt portion at a plurality of portions, and the skirt portion includes an outer surface in contact with the mask frame, an inner surface positioned opposite to the outer surface, and at least one of: (i) a plurality of concave portions and (ii) a plurality of convex portions formed on that region of the inner surface of the skirt portion which a contact surface of an electrode for resistance-welding contacts, in each of the welding portions, said at least one of: (i) the plurality of concave portions and (ii) the plurality of convex portions each having a smaller area than an area of the contact surface of the electrode, the contact surface of the electrode having a diameter smaller than a width of the skirt portion.

6. A cathode ray tube according to claim 5, wherein the skirt portion includes at least one of: (i) a plurality of concave portions and (ii) a plurality of convex portions formed in the outer surface, at each of the welding portions, said at least one of: (i) the plurality of concave portions and (ii) the plurality of convex portions each having a smaller area than the area of the contact surface of the electrode.

7. A cathode ray tube according to claim 5, wherein said at least one of: (i) the plurality of concave portions and (ii) the plurality of convex portions are formed to have a diameter and a pitch such that a contact area between the contact surface of the electrode and the inner surface of the skirt portion is 50 to 10% of the contact surface of the electrode.

8. A cathode ray tube according to claim 5, wherein the mask body has an oxide film which covers an entire surface of the mask body, and the mask frame has an oxide film which covers an entire surface of the mask frame.

* * * * *